United States Patent [19]

Ziegler

[11] 4,393,014

[45] Jul. 12, 1983

[54] METHOD OF CASTING EXPLOSIVE CHARGE WITH HIGH SOLIDS CONTENT

[75] Inventor: George E. Ziegler, Sparta, N.J.

[73] Assignee: The United States of America as represented by the Secretary of the Army, Washington, D.C.

[21] Appl. No.: 302,946

[22] Filed: Sep. 16, 1981

[51] Int. Cl.[3] ..... C06B 21/00

[52] U.S. Cl. ..... 264/3 R; 86/20 D; 149/92; 149/105

[58] Field of Search ..... 86/1 R, 20 D; 149/92, 149/105, 109.4; 264/3 R

[56] References Cited

U.S. PATENT DOCUMENTS

| | | | |
|---|---|---|---|
| 1,311,176 | 7/1919 | Moxham | 86/20 D |
| 2,361,382 | 10/1944 | Camin | 86/20 D |
| 3,107,574 | 10/1963 | Mebane | 86/20 D |

FOREIGN PATENT DOCUMENTS

| | | | |
|---|---|---|---|
| 2335925 | 2/1975 | Fed. Rep. of Germany | 149/105 |

*Primary Examiner*—Leland A. Sebastian

*Attorney, Agent, or Firm*—Robert P. Gibson; Anthony T. Lane; A. Victor Erkkila

[57] ABSTRACT

A high solids content explosive charge is formed by placing the dry solids such as RDX in a mold, adding TNT over the dry solids and holding the interior of the mold at an elevated temperature and reduced pressure to permit diffusion of the liquid TNT through the solids while the vacuum enhances the discharge of air from the mass. In one embodiment, a casing and liner of a shaped-charge warhead is employed for the mold and the TNT is placed in a funnel atop the casing. This assembly is placed inside a heated evacuated chamber for long enough to permit the liquid TNT to diffuse through the solid particles and for air to be discharged. In other embodiments, an air-tight casing is employed whose interior is evacuated while heating is performed.

9 Claims, 3 Drawing Figures

METHOD OF CASTING EXPLOSIVE CHARGE WITH HIGH SOLIDS CONTENT

GOVERNMENTAL INTEREST

The invention described herein may be manufactured, used and licensed by or for the Government for Governmental purposes without the payment to me of any royalty thereon.

BACKGROUND OF THE INVENTION

The present invention relates generally to explosive charges and, more particularly, to the melt casting of explosive charges with high solids content.

In melt-cast loading of shaped charges with trinitrotoluene (TNT), it is frequently desirable to include a high percentage of solids such as, for example, RDX (Cyclotrimethylenetrinitramine) or HMX (Cyclotetramethylenetetranitramine). A desirable solids content may be in the range from about 70% to about 75% of the mixture or higher.

Such melt-cast loading is normally performed by heating a mixture of TNT flake and the desired solids of relatively high melting point to a temperature exceeding about 85° C. and most preferably about 100° C. at which temperatures the TNT is liquefied, stirring the mixture to maintain the solids in suspension and then pouring the resulting mixture, usually employing a funnel or other aid, into a mold, such as shaped charge casing.

At high solids content above, for example, 70%, the mixture has a viscosity high enough to interfere with pouring and, in addition, tends to entrap air during pouring to produce resulting cavitation and discourages the settling of solid particles toward the shaped charge liner as may be desirable in some circumstances. The presence of porosity in the solidified cast charge leads to weaknesses in the charge which may permit unintentional initiation of the explosive by impact or by adiabatic compression upon firing of the charge from a weapon.

One method which has been employed to improve pourability is to dilute the mixture with sufficient TNT to reduce the solids content to 60%. This lowers the viscosity and the air entrapment during pouring and permits more of the solid particles, and particularly the coarse component of the solid particles, to settle toward the bottom of the mold which may be arranged to be the region where highest solids content is desired. Vibration may be employed with a prolonged heating period of the poured but not solidified explosive to encourage settling of solids. This method has permitted the achievement of a solids content as high as 85% at the bottom of the charge. However, this method requires a large riser in which the solids content is predominantly finer particles with a much lower proportion of solids than is desired in the main part of the charge. This riser represents wasted material.

A further method to increase the solids content includes pressing of a fine screen into the molten mixture thus forcing solid particles ahead of the screen while allowing the liquid TNT to rise through the screen. This method has also achieved a solid content of over 85% at the base of the charge. This method requires a significant time to accomplish and thus presents a production problem for quantity production of conditions.

Furthermore, the shape or other configuration of the charge may militate against use of this approach.

OBJECTS AND SUMMARY OF THE INVENTION

Accordingly, it is an object of the present invention to provide a method for a melt-cast loading of an explosive charge with a high solids content.

It is a further object of the invention to provide a method for melt-cast loading of shaped charged with RDX/TNT or HMX/TNT wherein the cast product has a solid content of at least 70% at the base of the munition.

It is a further object of the invention to provide a method for melt-cast loading of shaped charges in which the solid material is loaded directly into the munition without being previously mixed with TNT. The TNT is melted and is added to the solid material previously installed in the shaped charge. In the preferred embodiment, flake TNT is added over the solid particles and both are heated in an evacuated environment until the TNT melts and diffuses into the mass of solid particles. The mixture is held at an elevated temperature in a vacuum for long enough to diffuse the TNT through the mass of solid particles while the air in the charge is removed by the vacuum. Vibration may be employed to encourage diffusion.

According to an aspect of the invention, there is provided a method of casting an explosive charge of trinitrotoluene containing a high percentage of solid particles in a mold comprising adding the solid particles to the mold, adding an appropriate quantity of the trinitrotoluene to the mold over the solid particles, heating the mold with the solid particles and the trinitrotoluene contained therein whereby the trinitrotoluene is liquefied and diffuses into the mass of solid particles, drawing a vacuum in the mold whereby release of air from the explosive charge is encouraged, and continuing the heating and drawing step simultaneously for a long enough time to complete the diffusion and air releases.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
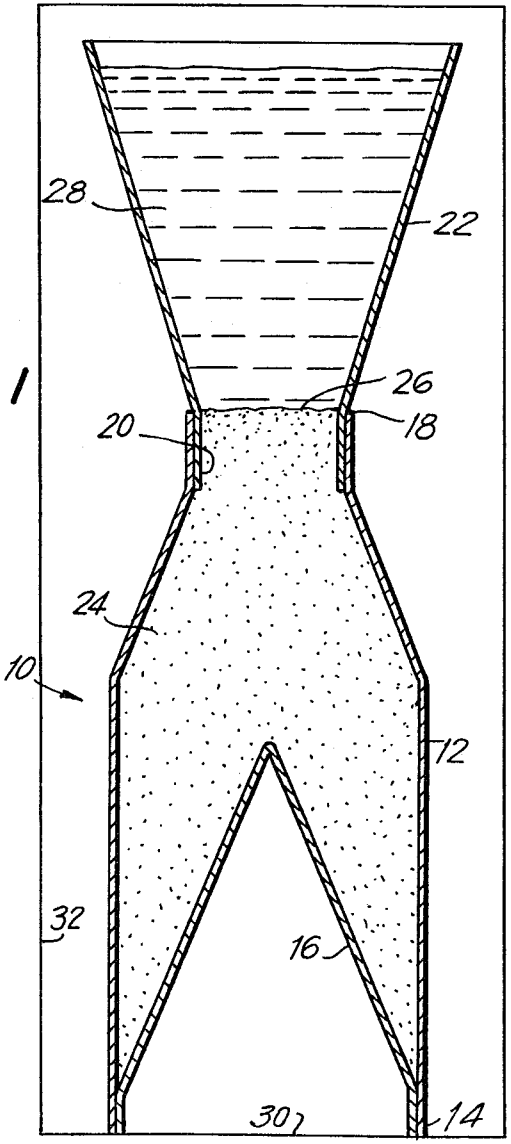
FIG. 1 is a cross section of a shaped-charge warhead being loaded according to an embodiment of the present invention.

Referring to FIG. 1, there is shown, generally at 10, a shaped-charge warhead being loaded according to the present invention. An outer casing 12 is joined at its lower perimeter to a generally conical shaped charge liner 16. As can be seen, shaped charge liner 16 closes the bottom of outer casing 12 to produce a closed container in which the charge can be cast.

A top opening 18 admits a neck portion 20 of a funnel 22. An appropriate amount of solid particles 24 is loaded dry in outer casing 12. Solid particles 24 may be of any suitable materials such as, for example, RDX or HMX and the particles may be coated with suitable material. The size mixture of solid particles 24 may be suitably adjusted for the function of which shaped-charge warhead 10 is to perform. In the embodiment of FIG. 1, outer casing 12 is filled to a line 26 which is even with top opening 18.

Liquid TNT 28 is poured in funnel 22 and percolates or diffuses downward through the mass of solid particles 24 to form the solid/liquid mixture filling outer casing 12. Preferably, the entire assembly is placed on a horizontal surface 20 within a chamber 32. Chamber 32 is preferably heated to help maintain the TNT in liquid condition and is partially evacuated to permit the escape of air from the mixfture in outer casing 12. Shaped-charge warhead 10 is maintained in this heated and evacuated environment for a period long enough for adequate diffusion and air discharge to be completed. The resultant solid-loaded charge is thereafter cooled by conventional means. Casing 12 may be vibrated by conventional means not shown during filling of solid particles, melting of TNT 28, and diffusion of liquid TNT into the mass of solid particles 24 or any combination of the preceding.

Due to the fact that liquid TNT 28 diffuses downward into the mass of solid particles 24 without the prior necessity for forming a suspension of solid particles 24 in liquid TNT 28, the original particle size mixture of solid particles 24 is essentially undisturbed. In addition, a relatively small amount of liquid TNT 28 remains as a riser above top opening 18. Furthermore, liquid TNT 28 in the riser after the completion of diffusion should contain little, if any, solid particles and may thus be reused if desired.

It would be clear to one skilled in the art that, instead of pouring liquid TNT 28 in funnel 22, flake TNT (not shown) may be placed in funnel 22 at room temperature and the assembly shown in FIG. 1 may then be placed inside chamber 32 wherein the application of heat liquefies the flake TNT which thereupon diffuses among solid particles 24.

It would be further clear to one skilled in the art that line 26 to which solid particles 24 are filled may be lower than top opening 18. In this case, the top portion of casing 12 is filled with liquid TNT while the bottom portion (the leading end of shaped-charge warhead 10) is filled with the solid loaded TNT. By permitting the top (aft) end of shaped-charge warhead 10 to be free of solid particles, its sensitivity to acceleration is reduced thus making it more suitable in high set-back applications.

The resulting percentage of solid particles 24 after diffusion of TNT thereinto depends upon the proportion of particle sizes in solid particles 24. That is, if an appropriate mixture of large, medium and small particle sizes is provided in solid particles 24, the interstitial spaces between larger particles is filled by smaller particles and thus, the proportion of liquid is reduced. Alternatively, if only large particles which fit together poorly are provided in the mass of solid particles 24, a relatively larger percentage of liquid may be absorbed therein.

Figure 2:
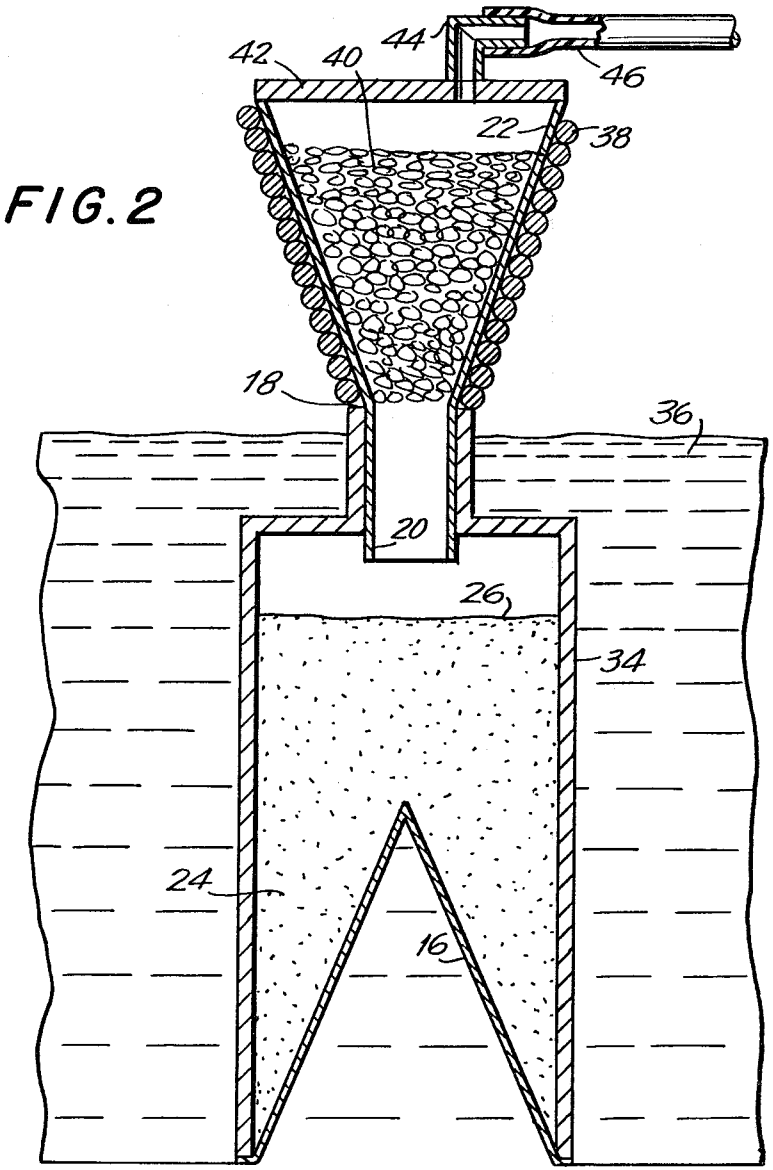
FIG. 2 is a cross section of a shaped-charge warhead being loaded according to a second embodiment of the invention.

Referring to FIG. 2, there is shown a second embodiment of the invention for high set-back applications. A casing 34 having its lower end closed by a shaped charged liner 16 is immersed in a body of hot water 36. Funnel 22 is surrounded by a heating coil 38 of any suitable type including electrical resistance heating or hollow coils containing circulating hot water.

A suitable amount of flake TNT 40 is placed in funnel 22. A sealing cover 42 is sealingly disposed at top of funnel 22. A vacuum connection 44 in cover 42 provides for connection of a vacuum hose 46 leading to a vacuum pump (not shown).

In the embodiment of FIG. 2, solid particles 24 are first loaded in casing 34 to a desifred line 26. The appropriate amount of flake TNT is then placed in funnel 22, sealing cover 42 is installed and the vacuum pump (not shown) is started. Heating coils 38 liquefy flake TNT 40 which thereupon enters casing 34 and diffuses into the mass of solid particles 24. The vacuum applied aids in the discharge of air from casing 34. After a suitable holding period to permit sufficient diffusion to take place, the vacuum is broken and a funnel 22 is removed. With the correct quality of flake TNT 40, an upper portion of the interior of casing 34 above line 26 is filled with substantially pure TNT to reduce the sensitivity of the overall charge at high set back applications.

It would be clear to one skilled in the art that vibration may be applied to casing 34 either directly or transmitted through hot water 36 to aid in the diffusion of the TNT into the mass of solid particles 24.

Figure 3:
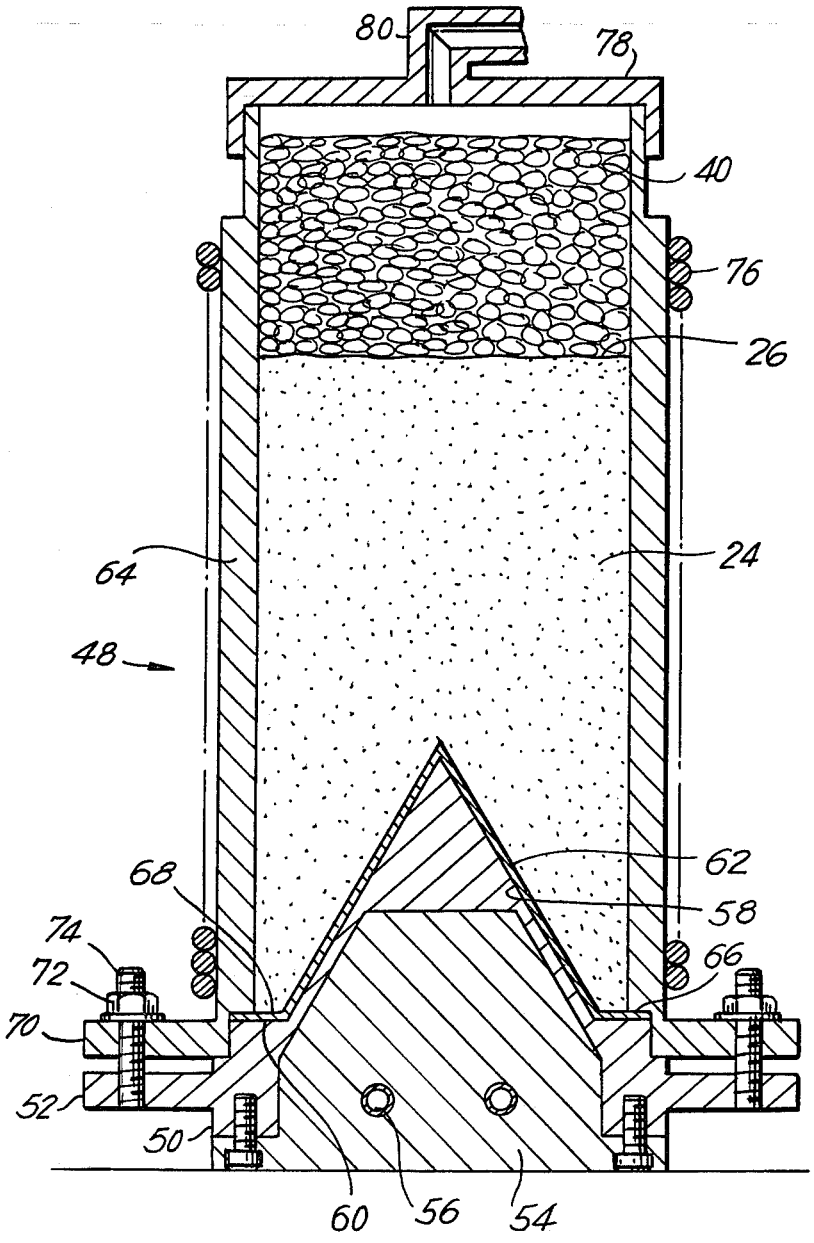
FIG. 3 is a cross section of an apparatus casting a charge for a shaped-charge warhead according to a third embodiment of the invention.

Referring now to FIG. 3, a shaped charge mold is shown generally at 48. A base 50 includes a flange 52 and a mandrel 54 which includes passages 56 through which heating liquid, such as, for example, hot water may be circulated.

Base 50 includes a conical upper surface 58 and an annular horizontal surface 60 for supporting and contacting a conventional conical liner 62 of a shaped charge.

A cylindrical mold casing 64 includes a step flange 66 suitable for fitting upon a lip 68 of conical liner 62. A flange 70 may be drawn sealingly toward flange 52 by a plurality of nuts 72 on screws 74 to thus sealingly clamp lip 68 between annular horizontal surface 60 and step flange 66.

A heating coil 76 surrounds mold casing 64 and is effective to elevate and maintain the temperature thereof to a suitable value.

A sealing cover 78 includes a vacuum connection 80 for connection with a vacuum pump (not shown).

In the embodiment shown in FIG. 3, a lip 68 of a conical liner 62 is clamped between annular horizontal surface 60 and step flange 66, solid particles 24 are added to a line 26 and an appropriate amount of flake TNT 40 is added over solid particles 24. Sealing cover 78 is then installed and a vacuum is drawn through vacuum connection 80. Mold casing 64 and mandrel 54 may be preheated by a fluid in passages 56 and heating coil 76 prior to filling the mold casing with solid particles 24 and flake TNT 40. Alternatively, mold casing 64 may be filled prior to heating.

As in previous embodiments, flake TNT 40 is liquefied by the heat applied thereto and diffuses into the mass of solid particles 24 to produce a high solid content explosive charge. By properly proportioning flake TNT 40 to solid particles 24, an amount of substantially pure TNT may be left above line 26 or, alternatively, substantially all of liquefied flake TNT 40 may be diffused among solid particles 24.

Having described a specific preferred embodiment of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of casting an explosive charge of trinitrotoluene containing a high percentage of solid particles insoluble therein in a mold comprising:

adding said solid particles to said mold;

adding an appropriate quantity of said trinitrotoluene to said mold over said solid particles;

heating said mold with said solid particles and said trinitrotoluene contained therein whereby said trinitrotoluene is liquefied and diffuses into said solid particles;

drawing a vacuum in said mold whereby release of air from said explosive charge is encouraged; and continuing the heating and drawing steps simultaneously for a long enough time to complete the diffusion and air release.

2. A method according to claim 1, wherein the steps of heating, drawing and continuing are performed by placing said mold containing said solid particles and said trinitrotoluene in a heated sealed chamber and evacuating air from said chamber.

3. A method according to claim 2, wherein said mold includes a casing of a shaped-charge warhead having a conical liner closing one end thereof.

4. A method according to claim 1, wherein said appropriate amount includes an amount exceeding the ability of said solid particles to absorb trinitrotoluene whereby a region of substantially pure trinitrotoluene is provided over a region of said solid particles with said trinitrotoluene diffused therethrough.

5. A method according to claim 1, wherein said trinitrotoluene is added as flake trinitrotoluene.

6. A method according to claim 1, wherein the step of heating includes contacting said mold with hot water.

7. A method according to claim 1, wherein said mold includes a conical liner closing one end thereof and the step of heating includes heating an exterior surface of said conical liner.

8. A method according to claim 7, wherein the step of heating an exterior surface includes contacting said exterior surface with a heated mandrel.

9. A method according to claim 1, wherein said solid particles include particles of at least one of HMX and RDX.

* * * * *